US005435064A

United States Patent [19]

Brookfield

[11] Patent Number: 5,435,064

[45] Date of Patent: Jul. 25, 1995

[54] PLANAR SURFACE SCRAPER

[75] Inventor: Grant H. Brookfield, Auckland, New Zealand

[73] Assignee: Modern Agencies Ltd., Auckland, New Zealand

[21] Appl. No.: 319,956

[22] Filed: Oct. 7, 1994

[51] Int. Cl.[6] ..... A47L 13/022

[52] U.S. Cl. ..... 30/169; 15/236.01; 30/339

[58] Field of Search ..... 30/169, 171, 329, 332, 30/333, 337, 339, 296.1; 15/236.01

[56] References Cited

U.S. PATENT DOCUMENTS

| | | | |
|---|---|---|---|
| D. 263,364 | 3/1982 | Bruno . | |
| D. 274,148 | 6/1984 | Levy . | |
| D. 303,861 | 10/1989 | Chen . | |
| 304,909 | 9/1884 | Coleman . | |
| 1,659,801 | 2/1928 | Basmaison . | |
| 1,726,017 | 8/1929 | Des Enfants, Sr. . | |
| 1,910,067 | 5/1933 | Charlton . | |
| 2,634,498 | 4/1953 | Abrahamsen | 30/339 X |
| 3,363,316 | 1/1968 | Skarsten . | |
| 3,670,414 | 6/1972 | Stecker . | |
| 4,612,707 | 9/1986 | Shea . | |
| 4,712,269 | 12/1987 | Worthen | 30/169 X |
| 4,890,351 | 1/1990 | Wilson | 30/169 X |
| 4,955,138 | 9/1990 | Henke et al. . | |
| 5,056,226 | 10/1991 | Gringer | 30/339 X |
| 5,208,984 | 5/1993 | Negus . | |

FOREIGN PATENT DOCUMENTS

| | | | |
|---|---|---|---|
| 9307010 | 4/1993 | WIPO | 15/236.01 |

*Primary Examiner*—Douglas D. Watts

*Attorney, Agent, or Firm*—Fay, Sharpe, Beall, Fagan, Minnich & McKee

[57] ABSTRACT

A scraper particularly suited for use in removing wall-covering comprises a scraper body having a handle extending upwardly from the top generally centrally thereof and guide and support legs extending outwardly from the rearward end. A scraper blade is operatively mounted on the bottom of the body to extend outwardly beyond the forward end of the body. The blade has a relatively flat rectangular configuration with a pair of elongated opposite sides constituting scraping edges. A retainer is provided for releasably retaining the scraper blade to position one of these scraping edges in operative position. The retainer includes a thin rigid plate for underlying the blade while leaving the selected scraping edge exposed. A pair of resilient latch arms extend upwardly from the plate through openings in the body. Each latch arm includes a latch element engaging a cooperating latch portion in the body. End portions of the latch arms extend to the top of the body and have exposed ends for releasing the latch element to permit blade changing.

12 Claims, 3 Drawing Sheets

PLANAR SURFACE SCRAPER

BACKGROUND OF THE INVENTION

The subject invention is directed toward the art of scraping devices and, more particularly, to a scraper tool adapted for manually scraping planar surfaces.

The invention is particularly suited for removing wallpaper and similar surface coverings and will be described with reference thereto; however, the invention is capable of broader application and could be used for removing coatings and imperfections from many different types of surfaces.

A variety of different scraping tools have been proposed and employed for removing wallpaper. The tools have varied from simple spatula types to combined scoring and scraping tools. Each of the prior scraping tools have been more or less adequate for such use. However, all have suffered from at least some defects such as difficulty of maintaining the proper blade angle, difficulty in sharpening or changing blades, weight, or awkwardness in use, and the like. With existing scrapers, it is easy to gouge the wall through lack of hand tool skills. Consequently, a need exists for a scraper that is truly suitable for removal of wall coverings.

SUMMARY OF THE INVENTION

The subject invention provides an improved manually operable scraping tool that is lightweight and is comparatively simple to use. In addition, the design is such as to maintain the blade at its most desirable angle with the surface being scraped.

In accordance with a preferred form of the invention, there is provided a scraper tool that is particularly suited for removing wallpaper and which comprises a scraper body having a base, a top, a bottom, a forward end, and a rearward end. A handle extends upwardly from the top of the body generally centrally thereof and guide and support legs extend outwardly from the rearward end of the body. Operatively mounted on the bottom of the body to extend outwardly beyond the forward end of the body is a scraper blade. The blade has a relatively flat rectangular configuration with a pair of elongated opposite sides and at least one of the elongated sides constitutes a scraping edge. Releasably retaining the scraper blade in a operative position is a retainer that includes a thin rigid plate for underlying the blade while leaving the scraping edge exposed. At least one resilient latch arm extends upwardly from the plate through an opening in the body. The latch arm includes a latch element engaging a cooperating latch portion in the body. The latch arm further includes an end portion extending to the top of the body and having an exposed end for releasing the latch element.

Preferably, and in accordance with a further aspect of the invention, there is a locating member which acts to locate the blade relative to the body and the rigid plate.

In accordance with yet another and more limited aspect of the invention, the scraping edge and the guide and support legs lie in a common plane spaced from the bottom of the blade. Additionally, the handle is located generally centrally between the cutting edge and the end support surfaces of the legs.

In its preferred form, the body is a relatively lightweight plastic molding, and the blade is arranged with cutting edges on each of its elongated opposite sides. The locating member which extends from the bottom of the body through an opening in the blade is positioned such that it enters the same opening irrespective of which of the two elongated side edges is functioning as the scraping blade.

As can be seen from the foregoing, the primary object of the invention is the provision of an improved scraping apparatus which is arranged to maintain the scraping edge at its most efficient angle and relationship to the scraper body and the force applying handle.

Yet another object is the provision of a scraping apparatus of the general type described wherein an improved relationship releasable connection exists between the blade and the body.

A further object of the invention is to provide a scraper which cannot gouge the wall with its corner edges.

A still further object of the invention is the provision of a scraper of the type described wherein blade changing is facilitated by an improved blade connection arrangement that relies on a resilient latch.

BRIEF DESCRIPTION OF THE DRAWINGS

The above and other objects and advantages will become apparent from the following description when read in conjunction with the accompanying drawings wherein.

DETAILED DESCRIPTION OF THE PREFERRED EMBODIMENT

Figure 1:
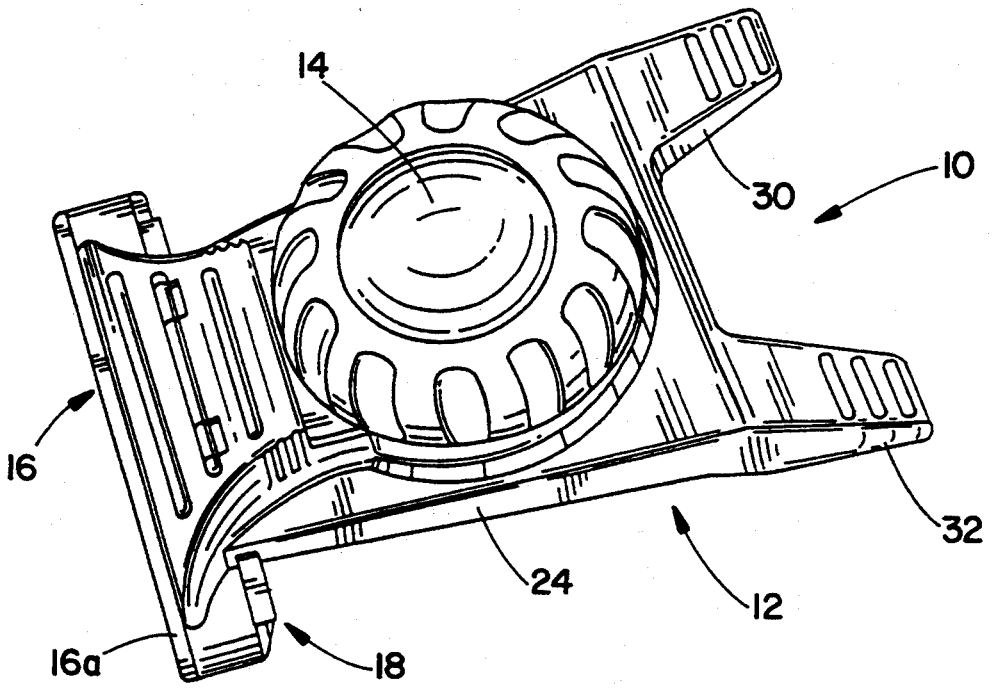
FIG. 1 is a perspective view of a scraper formed in accordance with the preferred embodiment of the subject invention.
Figure 2:
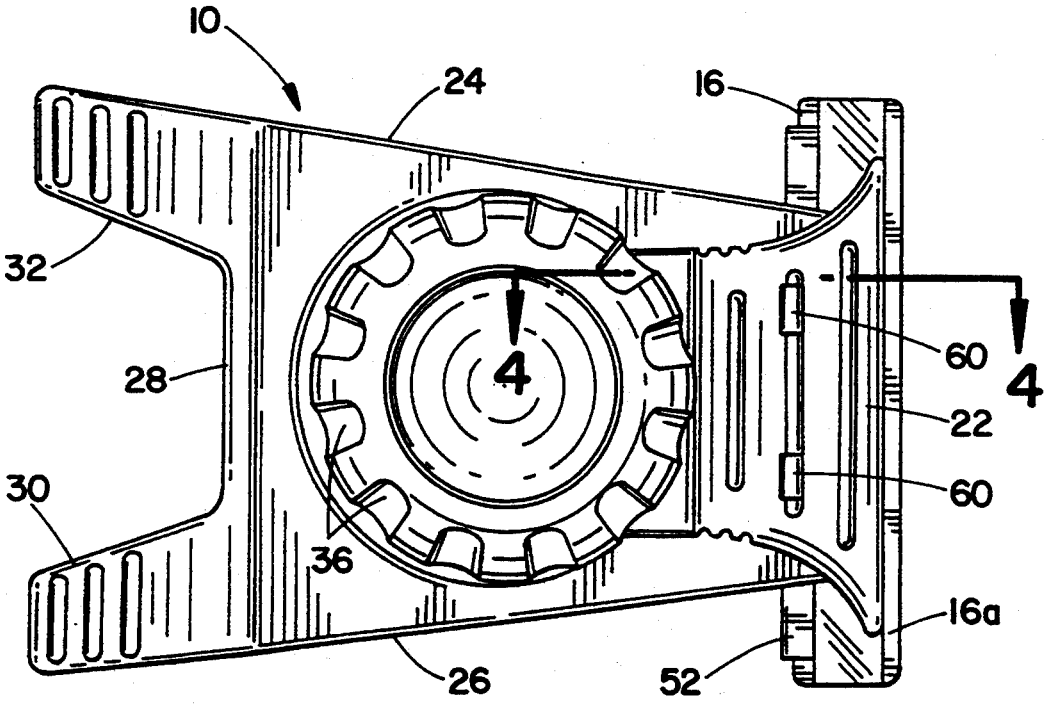
FIG. 2 is an enlarged top view of the scraper shown in FIG. 1.
Figure 3:
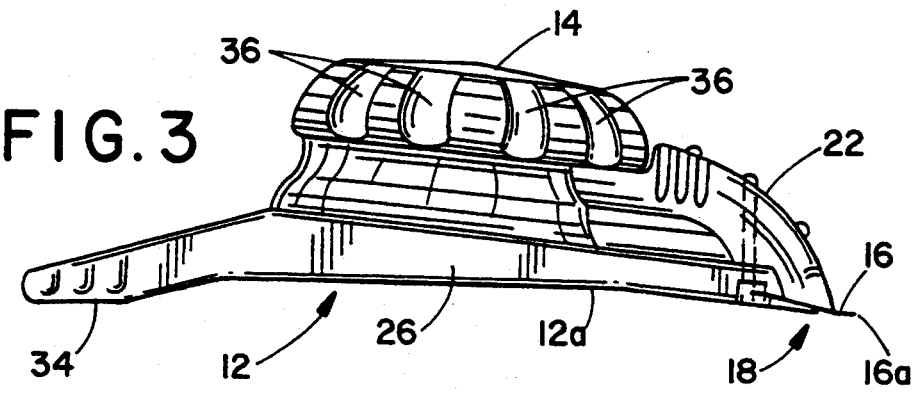
FIG. 3 is a side elevational view of the scraper of FIG. 1.

Referring more particularly to the drawings wherein the showings are for the purpose of illustrating a preferred embodiment of the invention only and not for the purpose of limiting same, FIGS. 1 through 3 show the overall arrangement of the scraper 10 which generally comprises a body 12 having an upwardly facing, centrally located handle 14. A scraper blade 16 is located at the forward end of body 12 and is held in place by a blade retainer assembly 18.

The body 12 is preferably of injection molded plastic and has a relatively rigid construction including a top 20, a forward end 22, and a pair of lateral sides 24 and 26. Extending from the rearward end 28 of body 12 are a pair of laterally spaced guide and support legs 30 and 32, respectively. The guide and support legs 30, 32 each terminate at their lower ends in support surfaces 34 (see FIG. 3) that preferably lie in a common plane with the bottom forward scraping edge **16*a* of scraping blade 16. The surfaces 34 and the scraping edge 16*a* are spaced downwardly from the bottom or lowest surface 12*a* of body 12**.

In the plan view of FIG. 2, it can be seen that the body 12 has a generally trapezoidal shape narrowing toward the forward end 22. The forward end 22 is rounded and curved downwardly as seen in FIGS. 3 and 4 and terminates a short distance behind the scraping edge 16a.

In the subject embodiment, the handle 14 is located substantially midway between the forward end of the body and the terminal ends of the guide and support legs 30, 32. Additionally, the handle is preferably centered laterally between the legs. Preferably, the handle 14 has a relatively large and relatively flat circular configuration adapted to fit comfortably within the palm of a user's hand. Also, suitable shallow recesses 36 are formed about the periphery of the handle to allow comfortable frictional engagement between the user's hand and the handle. This arrangement provides effective application of forces to the scraping edge and allows ready manual manipulation of the scraper.

Figure 4:
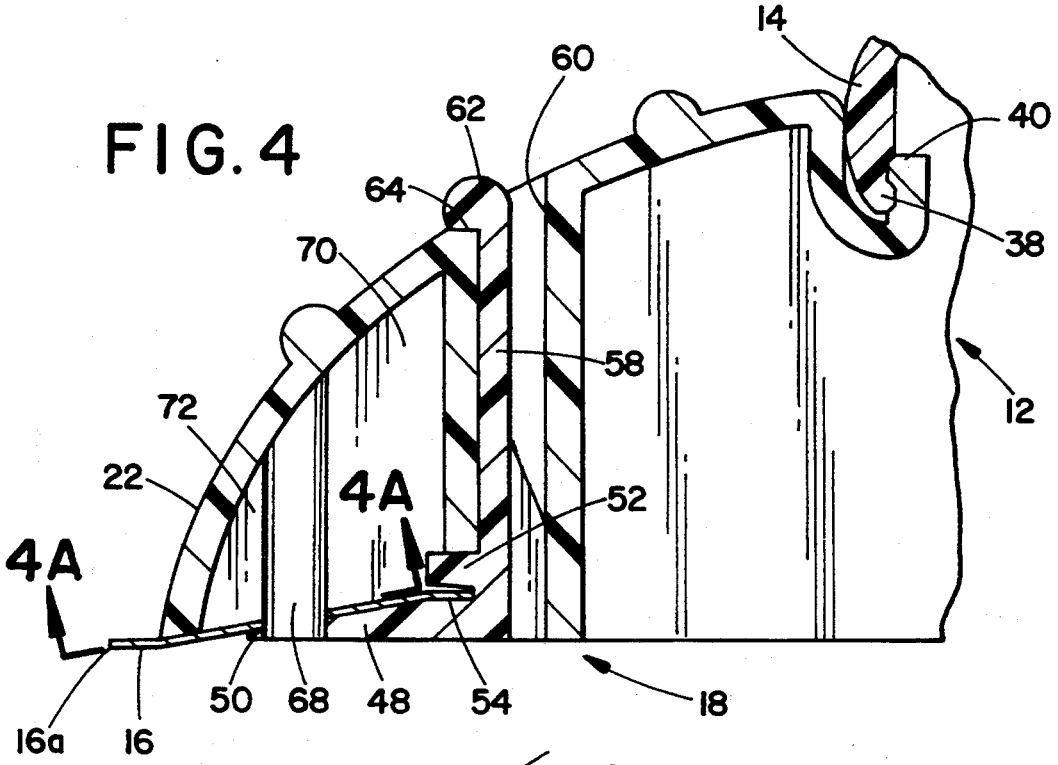
FIG. 4 is a greatly enlarged cross-sectional view taken on lines 4—4 of FIG. 2.
Figure 4A:
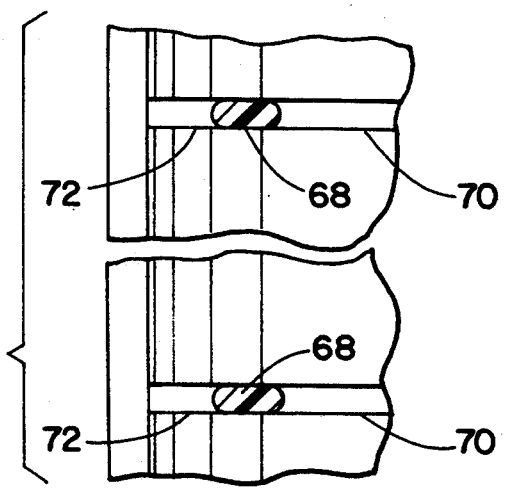
FIG. 4A is a partial cross-sectional view taken on lines 4A—4A of FIG. 4; and, FIG. 5 is a perspective view showing the scraper blade and the retainer used for holding the blade in place on the scraper body.

Although the handle 14 could obviously be molded integrally with the body 12, in the subject embodiment, it is molded as a separate component and resiliently snapped in place as seen in FIG. 4. That is, the handle 14 has a generally hollow configuration terminating in a lower edge 38 which extends circumferentially about the bottom of the handle and is adapted to resilient engage about a circular shoulder or laterally extending rib 40 formed on the top of body 12. The handle and the body could be formed of any suitable plastic material such as a high density polyethylene, a nylon, or some similar relatively rigid plastic or other resinous material.

Figure 5:
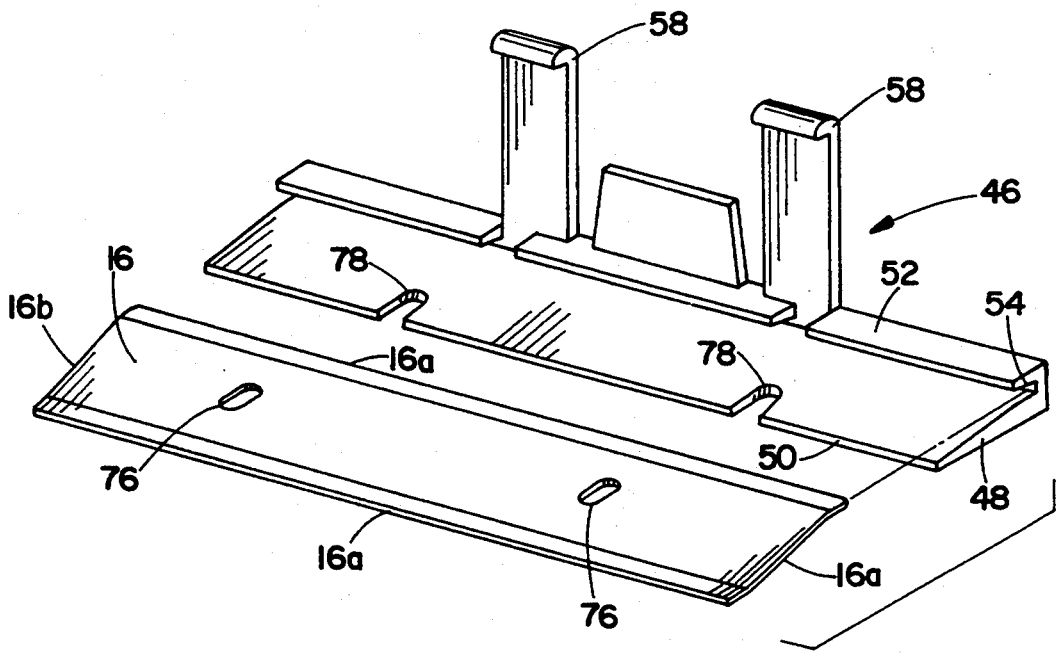

As previously mentioned, the scraping blade 16 is formed from a suitable metal and is held in position subjacent the forward end 22 of body 12 by a retainer assembly 18. In particular, as seen in FIG. 5, the blade has a generally rectangular configuration including a pair of elongated opposite side edges 16a and terminal end portions 16b. The longitudinal side edges 16a are each straight and sharpened to function as scraping edges. Additionally, it will be noted that although the blade is relatively flat, the side edges 16a are deflected slightly as shown. This allows the edges 16a to properly engage the surface being scraped and to define a planar relationship with the support surfaces 34 of the guide and support legs 30, 32.

As previously mentioned, the blade is held in position at the forward end of the body by the retainer assembly 18 which generally comprises a retainer member 46 that is releasably connected to the body to support and join the blade 16 thereto. As best seen in FIGS. 4 and 5, the retainer 46 comprises a comparatively rigid plate member 48 that is of a length nearly as great as the blade 16 (see FIG. 2). The plate 48 is relatively thin and tapers to a narrow forward edge 50. An upwardly extending rib or flange portion 52 is connected to the plate 48 at its rear edge and includes a groove 54 extending therealong. The groove 54 is adapted to receive and support the edge of the blade 16 which is not in use.

Extending upwardly from the rib 52 is a pair of resilient latch arms 58. As seen in FIGS. 2 and 4, the latch arms 58 are of a length so as to extend completely upwardly through the forward portion 22 of body 12. The body 12 is, as seen in FIGS. 2 and 4, provided with vertical openings 60 sized so as to receive the latch arms 58. At their upper free ends, the latch arms are each provided with a latch element 62 adapted to engage over a corresponding edge or latch element 64 formed on body 12. The underside of body 12 is provided with a suitable transversely extending recessed portion 66 that closely receives the rib 52 to hold the retainer in position longitudinally of the body. The upper ends of the latch element 62 are exposed above the top of the forward portion 22 of body 12. They can be released from their latch position by pushing them to the right as viewed in FIGS. 2 and 4. This allows them to be retracted downwardly together with the retainer plate 48 and the blade 16.

To further lock the blade in place and to rigidify the blade and retainer plate 50 in position on body 12, there are provided locating members in the form of downwardly extending pins or extensions 68 rigidly formed within the forward end of body 12 and supported in a longitudinal direction by internal reinforcing walls 70 and 72. The lower ends of the locating pin members 68 are sized and arranged to extend through correspondingly shaped openings 76 formed midway between the elongated side edges 16a of the blade 16 (see FIG. 5). In addition, the rigid support plate 48 is also provided with slots or openings 78 that are sized and positioned so as to receive the pins 68. Thus, when the retainer assembly 18 is in the latched position shown in FIG. 4, the pins 68 extend through the blade 16 and the rigid plate 48 to further engage and hold the blade in position.

As noted, the blade is symmetrical about its longitudinal axis and can be reversed in position so as to allow either of the side edges 16a to function as a scraping edge.

As can be seen from the foregoing, the shape and arrangement of the blade changing is extremely simple. Also, the blade is maintained in an effective scraping relationship at all times. Moreover, the location and arrangement of handle 14 assures that forces are conducted to the blade in a most efficient and effective manner.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A scraper particularly suited for scraping planar surfaces and removing wallcovering or the like comprising:

a scraper body having a base, a top, a bottom, a forward end, and a rearward end;

a handle extending upwardly from the top of the body generally centrally thereof and guide and support legs extending outwardly from the rearward end of the body;

a scraper blade operatively mounted on the bottom of the body to extend outwardly beyond the forward end of the body, the blade having a relatively flat rectangular configuration with a pair of elongated opposite sides, at least one of the elongated sides constituting a scraping edge;

a retainer for releasably retaining the scraper blade in operative position including a thin rigid plate for underlying the blade while leaving the scraping edge exposed; and, at least one resilient latch arm extending upwardly from the plate through an opening in the body, the latch arm including a latch element engaging a cooperating latch portion in the body, the latch arm further including an end portion extending to the top of the body and having an exposed end for releasing the latch element.

2. The scraper as defined in claim 1 wherein there is at least one locating member for locating the blade relative to the body.

3. The scraper as defined in claim 2 wherein the at least one locating member comprises a pin extending from the bottom of the body through an opening in the scraper blade.

4. The scraper as defined in claim 3 wherein the locating member extends into an opening formed in the plate.

5. The scraper as defined in claim 1 wherein scraping edge and the guide and support legs lie in a common plane spaced from the bottom of the body.

6. The scraper as defined in claim 5 wherein there are two guide and support legs each of which extends substantially the same distance from the body and each terminating in an end support surface spaced equidistance from the cutting edge.

7. The scraper as defined in claim 1 wherein the plate includes a raised rib for engaging the elongated side of the blade opposite the scraping edge.

8. The scraper as defined in claim 7 wherein the raised rib includes a groove into which a portion of the blade extends.

9. The scraper as defined in claim 8 wherein there are two of said resilient latch arms extending in parallel.

10. The scraper as defined in claim 1 wherein the handle is located substantially midway between the cutting edge and the said end support surfaces of the legs.

11. The scraper as defined in claim 9 wherein the latch arms are integral with the support plate.

12. The scraper as defined in claim 1 wherein both of the elongated sides of the scraper blade constitute a scraping edge.

* * * * *